United States Patent [19]

Tabata et al.

[11] 4,354,573

[45] Oct. 19, 1982

[54] SILENCER FOR MOTORCYCLE

[75] Inventors: Kazuki Tabata; Hideaki Honma, both of Toda, Japan

[73] Assignee: Sankei Giken Kogyo Kabushiki Kaisha, Tokyo, Japan

[21] Appl. No.: 234,634

[22] Filed: Feb. 17, 1981

[30] Foreign Application Priority Data

Feb. 21, 1980 [JP] Japan ..... 55-21826[U]

[51] Int. Cl.[3] ..... F01N 7/00; F01N 1/08

[52] U.S. Cl. ..... 181/239; 181/268; 181/275

[58] Field of Search ..... 181/227, 228, 239, 232, 181/268, 275, 257; 60/324; 239/558, 559

[56] References Cited

U.S. PATENT DOCUMENTS

| | | | |
|---|---|---|---|
| 1,685,701 | 9/1928 | Blanchard | 181/268 |
| 1,940,790 | 12/1933 | Diehl | 181/275 X |
| 2,187,674 | 1/1940 | Anderson et al. | 239/558 |
| 2,678,067 | 5/1954 | Russell | 60/324 X |

FOREIGN PATENT DOCUMENTS

| | | | |
|---|---|---|---|
| 629710 | 4/1963 | France | 181/268 |
| 352192 | 3/1961 | Switzerland | 181/268 |

*Primary Examiner*—L. T. Hix
*Assistant Examiner*—Thomas H. Tarcza
*Attorney, Agent, or Firm*—Polster, Polster and Lucchesi

[57] ABSTRACT

A tail cap of a silencer for a motorcycle which is so constructed that a plurality of kinds of tail cap, each having different shape and construction, are provided, which is interchangeably mounted and dismounted to and from the tail part of the silencer so as to change the outer appearance and design of the silencer.

6 Claims, 8 Drawing Figures

SILENCER FOR MOTORCYCLE

BACKGROUND OF THE INVENTION a. Field of the Invention

This invention relates to a silencer for automotive vehicle, and, more particularly, it is concerned with a tail cap of a silencer for a motorcycle.

b. Description of the Prior Arts

In recent years, an automotive vehicle such as a motorcycle, etc. is used, in most cases, as a vehicle for hobby, or leisure, or sports. In such cases, users of the vehicle are apt to practise, not infrequently, exchange of each and every component part of the motorcycle in pursuance of their likings. Further, road races and off-road races are held from time to time at every place of the country, for which purpose those component parts of the motorcycle are exchanged for freely converting the motorcycle to meet the road racing and off-road racing conditions.

Under such circumstances, the silencer becomes one of the exchanging items for various purposes. However, in the silencer for the motorcycle, as its outer appearance constitutes an important factor, it is exchanged not infrequently for the purpose of changing the external appearance and design of the motorcycle.

SUMMARY OF THE INVENTION

In view of the abovementioned, it is the primary object of the present invention to provide a silencer for a motorcycle which is capable of readily changing the external appearance and design without changing the silencer main body.

According to the present invention, there is provided a silencer tail cap for a motorcycle constructed with an outer cylinder having a diameter to snugly fit around an end of an exhaust pipe; an inner cylinder concentrically provided within the outer cylinder; and a plurality of spacers radially extending from the inner cylinder to the outer cylinder, openings define by and between adjacent spacers constituting exhaust gas outlets.

There has thus been outlined, rather broadly, the more important feature of the present invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based may be readily be utilized as a basis for the designing of other structures for carrying out the several purposes of the present invention. It is important, therefore, that the claims be regarded as including such equivalent construction so far as they do not depart from the spirit and scope of the present invention.

BRIEF DESCRIPTION OF THE ACCOMPANYING DRAWING

Specific embodiment of the present invention has been chosen for the purpose of illustration and description, and is shown in the accompanying drawing, forming a part of the specification, in which.

DESCRIPTION OF PREFERRED EMBODIMENTS

In the following, the present invention will be described in detail in reference to the accompanying drawing showing two kinds of the tail cap for the silencer.

Figure 1:
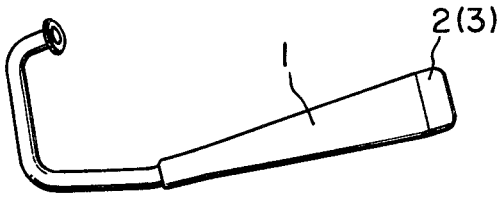
FIG. 1 is a front view of the silencer according to the present invention.
Figure 3:
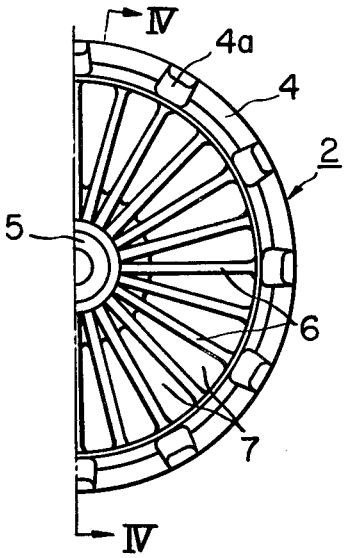
FIG. 3 is a side view of the tail cap shown in FIG. 2.
Figure 2:
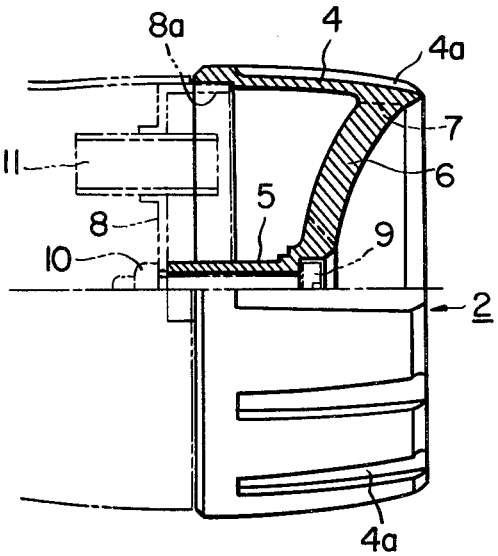
FIG. 2 is a longitudinal cross-sectional view showing a tail cap to be used in the silencer according to the present invention.
Figure 4:
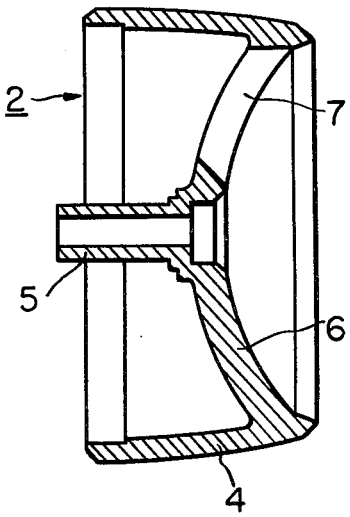
FIG. 4 is a cross-sectional view taken along a line IV—IV in FIG. 3.

The embodiment of the tail cap shown in FIGS. 2 to 4 is of such a construction that an inner cylinder 5, through which a bolt is screwed, is concentrically provided within a slightly tapered outer cylinder 4 in the direction of the center axis thereof, and a multitude of spacers 6 are radially extended from the inner cylinder 5 toward the outer cylinder 4, openings defined by and between adjacent spacers 6, 6 being made exhaust gas outlets 7. Also, by forming a multitude of grooves **4*a* in the outer peripheral surface of the outer cylinder 4** along the direction of the genetatrix, both designing and heat dissipating effects can be given to the silencer.

As shown in FIG. 2, this tail cap 2 is snugly fitted around a cylindrical portion **8*a* integral with an end plate 8 of the silencer 1, and a bolt 9 passed through the inner cylinder 5 is screwed into a nut 10 welded at the center of the end plate 8, thereby fixing the tail cap 2 to the silencer. Exhaust gas from the engine enters into a space formed in front of the spacers in the tail cap 2 through a tube 11, and exits from the exhaust gas outlets 7**.

Figure 5:
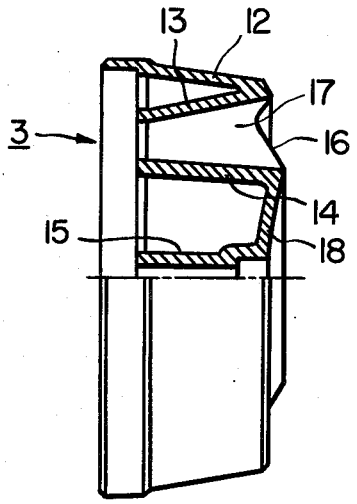
FIG. 5 is a longitudinal cross-sectional view showing another embodiment of the tail cap according to the present invention.
Figure 6:
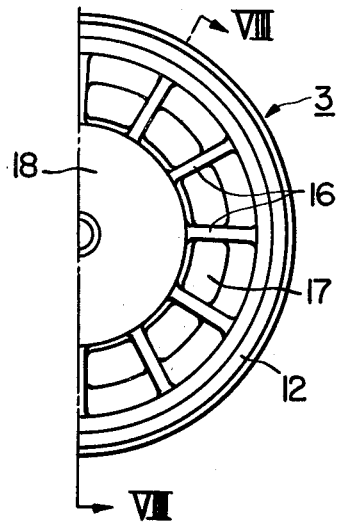
FIG. 6 is a right side view of the tail cap shown in FIG. 5.
Figure 7:
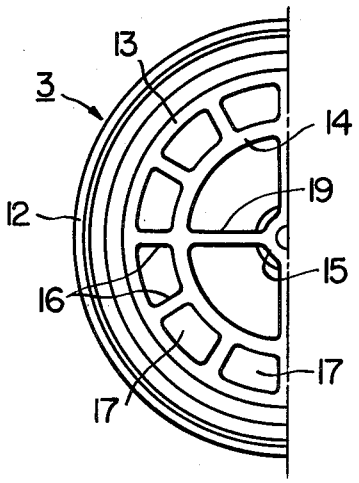
FIG. 7 is a left side view of the same.
Figure 8:
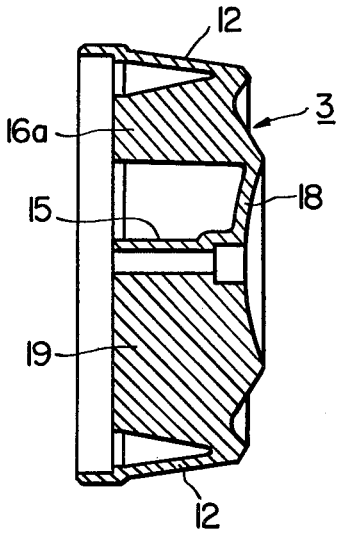
FIG. 8 is a cross-sectional view taken along a line VIII—VIII in FIG. 6.

Another embodiment of the tail cap shown in FIGS. 5 through 8 is constructed with a substantially frustoconical outer cylinder 12, an inner cylinder 13 associated with the outer cylinder 12 at its outer end brim in a manner to form a V-shaped cross-section in its lengthwise direction as shown in FIG. 5, an internal cylindrical portion 14 inside the inner cylinder 13, and an innermost cylindrical portion 15 to permit passage of a fitting bolt therethrough. These compoenents are all concentrically provided. Both inner cylinder 13 and internal cylindrical portion 14 are connected by a multitude of radially extending spacers 16 with openings defined by and between adjacent spacers 16, 16 being made exhaust gas outlets 17. The spacers 16 have the same depth as the outer cylinder 13 and the internal cylindrical portion 14 as indicated by a reference numeral **16*a* in FIG. 8. A reference numeral 18 designates a concaved arcuate (or parabolic) disc portion formed in the front face between the internal cylinders 14, 15, and a numeral 19 refers to spacers formed between the internal cylindrical portions 14, 15** (in the illustrated embodiment, four spacers are provided at four locations in a manner to intersect mutually orthogonally. The manner of fitting the tail cap comprising these cylindrical members and spacers to the silencer is the same as that of the previous embodiment.

The present invention is to provide several kinds of tail cap having different shape and construction, from which any one cap is arbitrarily chosen depending on one's liking and fitted on the silencer.

Since the present invention is so constructed as mentioned in the foregoing, it is possible to change the design of the silencer as a whole by giving a peculiarity in the design of each and every tail cap, which is therefore efficacious in differentiating the outer appearance of silencer according to one's liking.

Incidentally, the tail cap can be made by casting metal material of a relatively light weight such as aluminum, etc., whereby it is possible to easily manufacture any complicated congiguration which could not be obtained by conventional press working. At the same time, the tail cap is formed with a thicker gauge than the conventional ones to prevent generation of high frequency sound at the tail portion, without forfeiture of lightness in weight. The tail cap can also be formed integral with the tail pipe 11.

What is claimed is:

1. In a tail cap of a silencer for a motorcycle comprising an outer cylindrical member having a diameter to fit on and around one end of an exhaust pipe, an inner cylindrical member concentrically positioned in said outer cylindrical member, and a spacer to maintain said outer and inner cylindrical members at an equal distance for their concentricity, the improvement comprising a multiplicity of spacers radially extending from said inner cylinder toward the inner surface of said outer cylinder in an arcuate shape in longitudinal cross-section to define, by and between adjacent spacers, openings constituting the exhaust gas outlet.

2. A tail cap of a silencer for a motorcycle, comprising:

(a) an outer cylinder having a diameter to snugly fit around an end of an exhaust pipe;

(b) an inner cylinder associated with the outer cylinder at the outer end thereof to form a V-shaped cross-section along the lengthwise direction;

(c) another cylindrical portion internal to the inner cylinder;

(d) a plurality of spacers radially extending between said internal cylindrical portion and said inner cylinder, said spacers having the same depth as that of said cylinders, and openings defined by and between adjacent spacers constituting exhaust gas outlets;

(e) innermost cylinder concentrically disposed with said outer cylinder, inner cylinder, and internal cylindrical portion;

(f) a plurality of spacers radially extending between said innermost cylinder and said internal cylindrical portion, said spacers having the same depth as that of said cylinders; and (g) a parabolic disc member covering the space between said innermost cylinder and said internal cylindrical portion.

3. The improvement as set forth in claim 1, wherein a plurality of grooves are formed in the outer peripheral surface of said outer cylinder in and along the direction of the generatrix thereof.

4. The tail cap as set forth in claim 1 or 2, which is formed by casting aluminum and the like metal material having relatively light weight and good heat dissipating factor.

5. The tail cap as set forth in claim 1 or 2, wherein said cap is formed as thick as possible in gauge to an extent that it does not sacrifice lightness in weight.

6. The tail cap as set forth in claim 1 or 2, wherein it is formed integral with the tail pipe of the silencer.

* * * * *